US005423151A

United States Patent [19]

Caro et al.

[11] Patent Number: 5,423,151

[45] Date of Patent: Jun. 13, 1995

[54] TACKABLE TILE

[75] Inventors: Victor V. Caro, Hudsonville; David Boruta, Grand Haven; William Ellis, Belmont; John VanderWal, Grand Rapids; Randy Barnard, Rockford, all of Mich.

[73] Assignee: Herman Miller, Inc., Zeeland, Mich.

[21] Appl. No.: 759,551

[22] Filed: Sep. 13, 1991

[51] Int. Cl.[6] ..... E04B 1/82

[52] U.S. Cl. ..... 52/145; 52/144; 52/239; 181/284; 181/290; 428/47; 428/49

[58] Field of Search ..... 52/475–477, 52/239, 144, 145, 36, 656, 172, 511; 160/135, 351; 181/284–292; 428/47, 48, 49

[56] References Cited

U.S. PATENT DOCUMENTS

| | | | |
|---|---|---|---|
| 3,782,495 | 1/1974 | Nassof | 52/144 |
| 3,949,827 | 4/1976 | Witherspoon | 52/239 |
| 3,971,178 | 7/1976 | Mazzoni et al. | 52/172 |
| 4,248,325 | 2/1981 | Georgopoulos | 181/284 |
| 4,391,073 | 7/1983 | Mollenkopf et al. | 52/239 |
| 4,428,454 | 1/1984 | Capaul et al. | 181/291 |
| 4,441,580 | 4/1984 | Webster | 181/286 |
| 4,627,199 | 12/1986 | Capaul | 181/290 |
| 4,924,969 | 5/1990 | L'Heureux | 181/287 |
| 5,003,740 | 4/1991 | Dull et al. | 52/36 |
| 5,009,043 | 4/1991 | Kurrasch | 52/145 |
| 5,129,202 | 7/1992 | Payne et al. | 52/145 |

*Primary Examiner*—Carl D. Friedman
*Assistant Examiner*—Winnie Yip
*Attorney, Agent, or Firm*—Willian Brinks Hofer Gilson & Lione

[57] ABSTRACT

A tackable tile for mounting to a frame to provide a tackable surface to a wall having one or more of such tiles is disclosed. The tile includes a frame defining an open central portion, and a composite tackable member conforming to the perimetric shape of the frame and mounted in the open central portion thereof. The composite tackable memeber includes a resilient pierceable layer of material, and a layer of noise reducing acoustic material. The layer of pierceable material has a front and a rear side, and the acoustic material is adhered to the rear side of said resilient pierceable layer.

25 Claims, 2 Drawing Sheets

FIG. 1
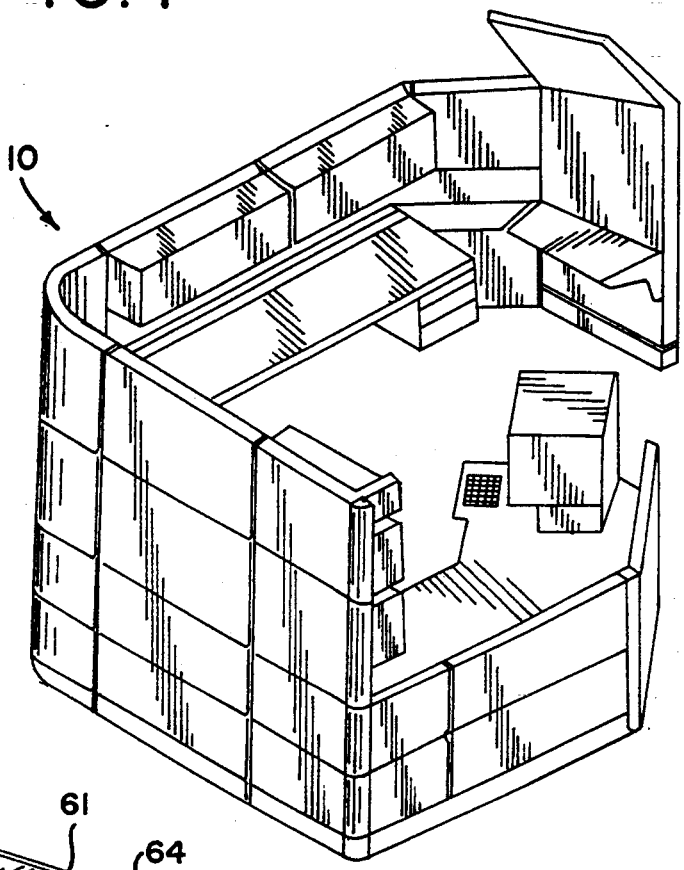
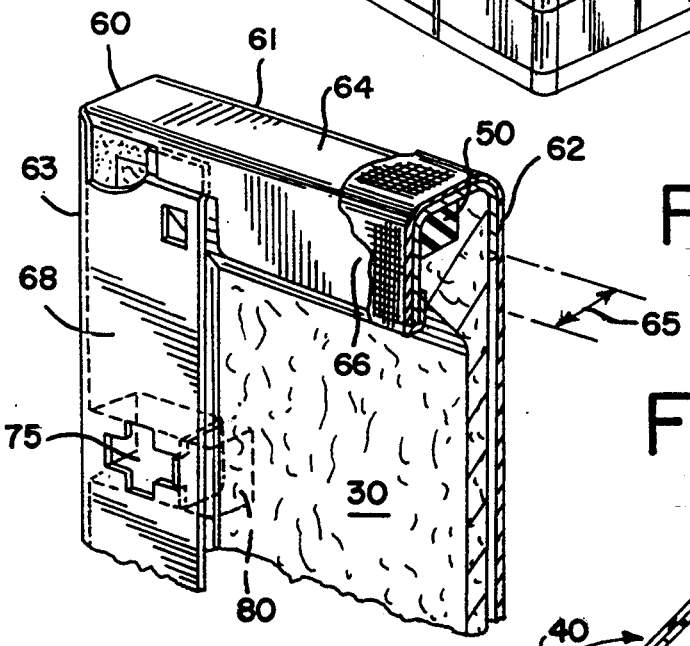
FIG. 3
FIG. 4
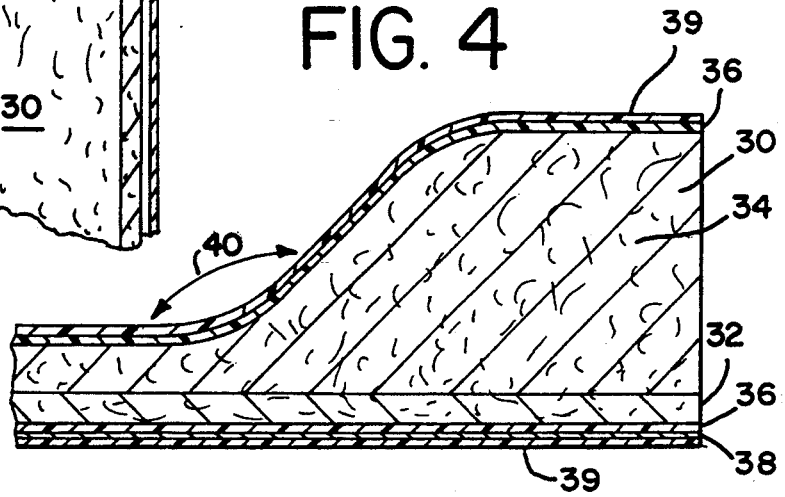

TACKABLE TILE

BACKGROUND OF THE INVENTION

The present invention relates to the field of tackable tiles. More particularly, the invention relates to a method of forming a tackable tile which can be used as a wall panel in creating a modular office system.

In some office arrangements, it is deskable to have the workplace divided into several individual work areas by partitions which form a modular office system. These modular office systems typically consist of a framework on which are removably fastened a plurality of wall panels. Generally, a wall panel may consist of a plurality of individual tiles which are affixed together to form the wall or may be formed from a single tile.

Providing a modular office system that is both aesthetically pleasing and functional can be a challenge. Various types of modular office systems have been developed which make use of removable tiles. However, often these tiles have limited flexibility and may become misshapen or deformed when articles or materials are affixed or tacked to their surfaces.

SUMMARY OF THE INVENTION

Briefly stated, the present invention is a tackable tile for use in creating a modular office system. More specifically, the present invention is a tackable tile for mounting to a frame to provide a tackable surface to a war which may include one or more of such tiles. A tackable tile of the present invention includes a frame that defines an open central portion and a composite tackable member which conforms to the perimetric shape of the frame and is adapted to be mounted in the open central portion of the frame. The composite tackable member includes a layer of resilient pierceable material having a front and a rear side. Additionally, the composite tackable member includes a layer of noise reducing acoustic material that is adapted to be adhered to the back side of the resilient pierceable material.

In a preferred embodiment of the present invention, the frame includes an upper rail, a lower rail, each of which has a channel; and a first and second end cap, each of which also have a channel such that a channel exists about the periphery of the frame into which the composite tackable member is fitted.

In the preferred embodiment of the present invention, the layer of noise reducing acoustic material of the composite tackable member has a greater density about the central portion of the composite member than that of the density about the outermost periphery of the composite.

In a more preferred embodiment of the present invention, the composite tackable member further includes a layer of fire resistant material which is adhered to at least one layer of the composite member.

In a most preferred embodiment of the present invention, the composite tackable member includes at least one layer of aesthetic covering material and at least one layer of film bonding material. The layer of aesthetic covering material is adhered to the front outermost and rear outermost layer of the composite member prior to the composite member being mounted in the frame. The layer of film bonding material is adhered to at least one layer of the composite tackable member to aid in maintaining the composite member's shape.

Typically, a spline formed of resilient flexible material is threaded between the inner rear portions of the frame and the rear outermost layer of the composite tackable member.

Typically, a fabric wrap is provided which covers at least the front portion of the frame and at least the front outermost layer of the composite tackable member.

The present invention offers several advantages. The advantages include providing a tackable tile with a tackable surface which is sturdy yet flexible and has the ability to maintain its shape when materials are tacked to its surface. Further, the structure of the composite tackable member with its layer of noise reducing acoustic material aids in reducing the level of noise between adjoining modular office units.

The present invention, together with its attendant objects and advantages, will be best understood with reference to the detailed description below read in conjunction with the accompanying drawings.

BRIEF DESCRIPTION OF THE DRAWINGS

FIG. 1 is a perspective view of a modular office system which includes tackable tiles made in accordance with the present invention.

FIG. 3 is an exploded view of a tackable tile made in accordance with the present invention.

FIG. 4 is a cross-sectional view of the substrate material of the present invention.

DETAILED DESCRIPTION OF THE PREFERRED EMBODIMENTS

Referring to FIG. 1, a modular office system 10 which includes tackable tiles is shown. A tackable tile made in accordance with the present invention is made by combining a frame which includes an open central portion with a composite tackable material which is configured and formed to the perimetric shape of the frame and may be mounted in the open central portion thereof.

A tackable tile made in accordance with the present invention has the ability to provide a sturdy, yet flexible, resilient pierceable surface upon which materials or objects may be affixed without damage to the tile's surface or distortion to the tile's shape. A tile made in accordance with the present invention can vary in shape and size. Preferably the tile is rectangular in shape and is adapted to be removably mounted on frames through clips and hooks in the manner disclosed in the Kelly et al. U.S. Pat. No. 4,685,255. The frame will be discussed in greater detail below.

A fabric overwrap may be adhered to cover the frontal face of the tile. The overwrap and method of attaching the overwrap will be discussed in greater detail below.

Figure 5:
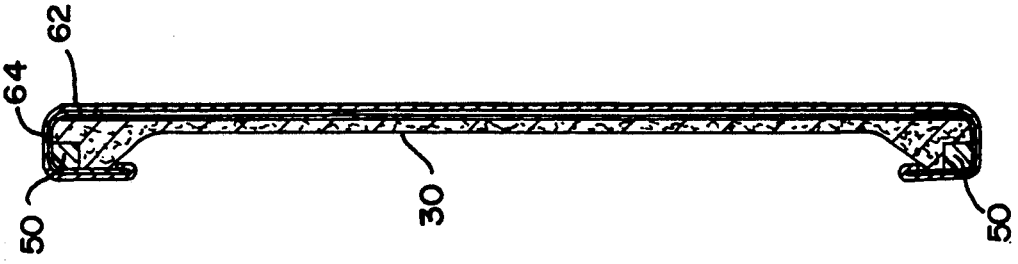
FIG. 5 is a cross-sectional view of the tile of FIG. 2 taken along lines 5—5.
Figure 2:
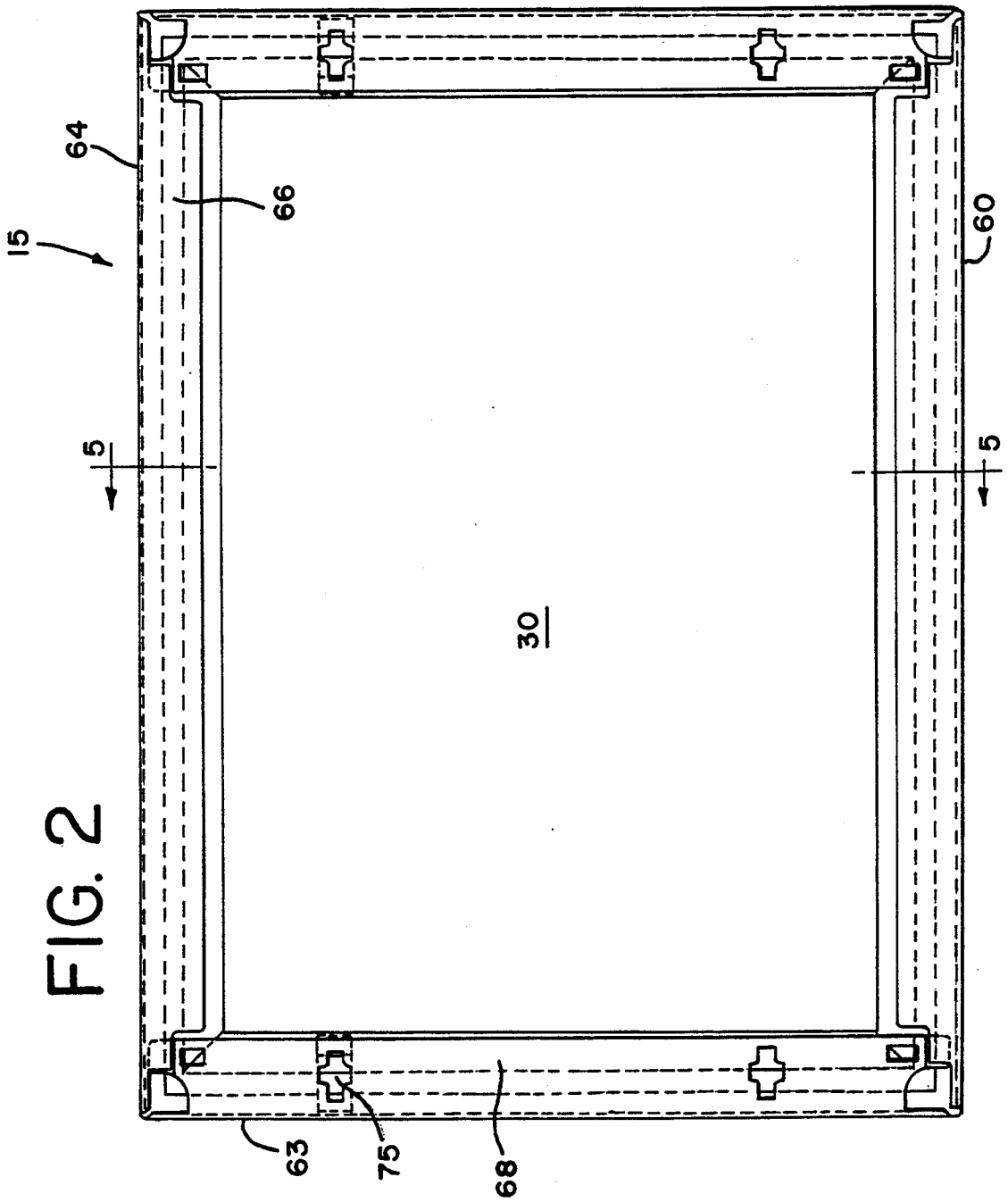
FIG. 2 is a plan view of a tackable tile made in accordance with the present invention.

A tackable tile made in accordance with the present invention is made by providing a resilient pierceable composite tackable member which is sturdy yet flexible and may be fitted into a frame as illustrated in FIG. 2 and FIG. 5.

In a preferred embodiment of the present invention, the frame is made from a sturdy material such as metal or ceramic to give rigidity to the frame. Preferably, the frame of the present invention is relatively rigid or semi-rigid and is substantially similar to that disclosed in U.S. Pat. No. 4,832,152, which is herein incorporated by reference. Accordingly, the frame consists of an upper and lower rail and a first and second end cap. Preferably the upper and lower rails and the end caps are compose, of a metal such as steel. The upper and lower rails are generally J-shaped in cross section and consist of a front portion, a rear portion, and a web portion. These portions form a channel. Similarly, the end caps are also generally J-shaped in cross section and consist of a front portion, a rear portion, and web portion. These portions also form a channel. The composite tackable member is fitted into the channels of the upper and lower rails and the channels of the end caps. The front portions of the upper and lower rails and the front portions of the end caps are a predetermined height shorter than their respective corresponding rear portions.

Preferably, located near the lateral edges of the upper and lower rails are bilateral step portions for tucking the fabric overwrap into the tile and for assembling the tile frame. Referring now to the end caps, preferably located at the upper and lower end of each end cap are projections which are perpendicular to the front, rear and web portions of the end cap. Additionally, the rear portion of the end caps has a plurality of holes and cutout portions of predetermined geometric shapes which will be described in greater detail below.

In a preferred embodiment of the present invention, the composite tackable member used in making a tackable tile is formed by combining layers or sheets of a plurality of materials. The composite tackable member is configured and shaped to be mechanically fitted into a frame. The length and width dimensions of the composite tackable member may vary according to the size of the tackable tile desired. Generally, a composite tackable member made in accordance with the present invention includes at least one layer of a resilient pierceable material. This layer provides a sturdy support for materials or items that are tacked onto the tile. Although this layer is flexible and elastic, it is formed from materials capable of holding firmly in place and of supporting the combined weight of the item to be tacked and the tack that pierces its surface without sagging or deforming.

In a preferred embodiment of the present invention, a composite tackable member includes at least one layer of a resilient pierceable material that has a front and rear side. Preferably, the sheet of resilient pierceable material is formed of a material such as polyvinyl chloride. Material such as polyvinyl chloride provides a surface which is pierceable and flexible. More preferably, the sheet of polyvinyl chloride is a mineral filled molded synthetic rubber polymer such as 5.3 oz. per $ft^2$ black PVC sheeting which is manufactured by Vinyl Plastics of Sheboygan, Wis., other suitable grades may be used. In a preferred embodiment of the present invention the sheet of resilient pierceable material is formed of polyvinyl chloride that has a thickness of approximately 0.02 inches to approximately 0.10 inches.

In accordance with the present invention, adhered to one side of the sheet of resilient pierceable material is a layer or sheet of noise reducing acoustic material. The layer of noise reducing acoustic material is sized and configured to cover at least an entire side of the resilient pierceable material. Preferably, the acoustic material is adhered to the rear side of the resilient pierceable material. Material such as uncured fiberglass maybe used to form the sheet of acoustic material. More preferably, compressed fiberglass such as 1.5 lb. per $ft^3$ black uncured fiberglass manufactured by Manville, Inc. of Defiance, Ohio, may be used to form the sheet of acoustical noise reducing material.

In a preferred embodiment of the present invention, the layer of acoustic material varies in thickness between the central portion of the composite and the perimeter of the composite. The acoustic material about the central portion of the composite is compressed and provides a high density filler material. The acoustic material about the perimeter of the composite is less compressed and is less dense than the acoustic material about the central portion. Preferably the layer of acoustic material about the central portion of the composite has a density of approximately 5 lbs./$ft.^3$ to approximately 12 lbs./$ft.^3$. Preferably, about the perimeter of the composite the layer of acoustic material has a density of approximately 1 lb./$ft.^3$ to approximately 6 lb./$ft.^3$. The less dense perimeter of the layer of acoustic material allows for greater flexibility when assembling a tackable tile made in accordance with the present invention. Preferably, the acoustic material is less dense about the perimeter of the composite, and the thickness of the acoustic material is increased from that of the thickness of the acoustic material about the central portion of the composite. The thickness of the layer of acoustic material increases gradually from the central portion of the composite tackable member to the perimeter portion of the composite tackable member as the density of the layer of acoustic material decreases. Preferably, the thickness of the layer of acoustic material is increased along a gradual angular incline. Alternatively, the thickness of the layer of acoustic material is increased from the central portion to the perimeter portion on an incline that forms a right angle with and is perpendicular to the central portion.

In a preferred embodiment of the present invention, the layer of acoustic material is formed of fiberglass such that the layer of fiberglass about the perimeter of the composite is approximately 0.600 inches to 1.00 inches thick. Preferably the layer of fiberglass about the central portion of the composite is approximately 0.05 inches to 0.400 inches thick. Preferably, the angle of the gradual incline is approximately 120° to approximately 150°.

In a more preferred embodiment of the present invention, the composite tackable member further includes a layer of fire resistant material. The layer or sheet of fire resistant material is adhered to at least one layer of the composite tackable member. Preferably, the layer of fire resistant material is adhered close to the outermost layer of the composite tackable member. Material such as aluminum may be used to form the layer of fire resistant material. Preferably such material has a thickness of between approximately 0.00009 inches to approximately 0.0035 inches. More preferably facing aluminum such as 0.001 0-temper aluminum foil manufactured by Consolidated Aluminum of Jackson, Tenn., may be used to form the layer of fire resistant material.

Referring now to the FIGURES, FIG. 2 is a plan view of a preferred embodiment 15 of the present invention. As illustrated, the composite tackable member 30 is mounted in the open central portion of the frame 60. FIG. 3 illustrates an exploded cross-sectional view of a tackable tile made in accordance with the present invention. The front portion 62, rear portion 66, and web portion 64 of the upper rail 61 of the frame 60 illustrate how the channel 65 is formed. The rear portion 68 of the upper half of the end cap 63 illustrate the specific geometric shapes and cutouts of the end caps of the frame 60. Similar geometric shapes and cutouts are found on the lower half [not shown] of the end cap 63 and on the second end cap [not shown].

As illustrated in FIG. 3, there is a support bracket 80 that is located at each end cap hole 75. Preferably the support bracket is made of metal and is generally U-shaped in cross-section. The bracket 80 is inserted into each end cap 63 prior to assembly of the tile frame 15. The bracket is inserted such that a portion of the bracket abuts the web portion of the end cap 63 and extends through a portion of the end cap hole 75 and is directed toward the rear portion 68 of the end cap 63. The bracket aids in providing structural support for the end caps 63 so they will not warp under the forces exerted during installation and removal of the tile 15. Accordingly, cutout portions which correspond to the brackets in the end caps are necessary in the composite tackable material to provide clearance for the bracket 80 of each end cap 63. In addition, FIG. 3 illustrates a composite tackable member 30 mounted in a frame 60.

A most preferred embodiment of the composite tackable member of the present invention is illustrated in FIG. 4. In this embodiment adhered to front side of the layer of resilient pierceable material 32 is a first layer of thin film bonding material 36. Preferably material such as Surlyn TM, which is manufactured by DuPont, of Wilmington, Del., is used. The layer 36 of film bonding material is sized and shaped to cover the entire front side of the layer of resilient pierceable material 32. Preferably, the layer of film bonding material is approximately 0.0005 inches to approximately 0.0050 inches thick. Adhered to the first layer 36 of film bonding material is a layer of fire resistant material 38. The layer of fire resistant material is sized and shaped to cover the exposed surface of the film bonding material. Preferably, material such as facing aluminum is used, although other suitable fire resistant materials may be used. Preferably the layer of fire resistant material is approximately 0.0005 inches to approximately 0.0015 inches thick. Adhered to the layer of fire resistant material is a first outer layer of aesthetic coveting material 39. The first outer layer of aesthetic covering material is sized and shaped to cover the exposed surface of the layer of fire resistant material 38. Preferably, mat blended black polyester rayon is used for the first outer layer 39, and is approximately 0.0005 inches to approximately 0.0015 inches thick. More preferably, material such as charcoal grey polyester-rayon blend fabric manufactured by Stearn's of Cincinnati, Ohio, may be used to form the layer of aesthetic coveting.

In the most preferred embodiment of the present invention illustrated. in FIG. 4, adhered to the back side of the layer of resilient pierceable material is a layer of noise reducing acoustic material 34 as described previously. Preferably, the layer of noise reducing acoustic material varies in density and in thickness between a central portion of the composite and an outermost periphery portion of the composite as described previously. In this most preferred embodiment, the layer of acoustic material is formed of uncured fiberglass and has a density of approximately 6 lbs./ft.$^3$ to approximately 10 lbs./ft.$^3$ about the central portion of the composite member. Additionally, in this most preferred embodiment, the layer of acoustic material has a density of approximately 1 lb./fl.$^a$ to approximately 4 lbs./ft.$^3$ about the periphery portion of the composite member. As the density of the acoustic material decreases, the thickness of the material increases. Most preferably the thickness of the layer of fiberglass about the periphery portion of the composite is approximately 0.500 inches to approximately 0.900 inches. Most preferably the thickness of the layer of fiberglass about the central portion of the composite is approximately 0.100 inches to approximately 0.300 inches thick. Preferably the thickness of the fiberglass is increased along a gradual angular incline 40. Most preferably, the angle 40 of the gradual incline is approximately 130° to approximately 140°.

In accordance with the most preferred embodiment of the composite tackable member illustrated in FIG. 4, adhered to the layer of acoustic material is a second layer of thin film bonding material, such as Surlyn TM, 36. The layer of thin film bonding material is sized and shaped to cover the entire exposed surface of the layer of acoustic material. Preferably the layer of film bonding material is approximately 0.0005 inches to approximately 0.0050 inches thick.

Adhered to the second layer of thin film bonding material is a second outer layer of aesthetic coveting material 39. The second outer layer of aesthetic coveting material is most preferably polyester rayon that is sized and shaped to cover the exposed surface of the second layer of thin film bonding material. Preferably the second outer layer of rayon is approximately 0.0005 inches to 0.0015 inches thick.

Most preferably the composite tackable member of the present invention is substantially the same as that made by Sound Tech, Inc. of Grand Rapids, Mich. under the name Herman Miller Tackable Tile.

In a preferred embodiment, a spline 50 is also mounted in addition to the composite tackable member into the rigid frame. The spline is formed from a flexible material. Preferably, the spline is formed from a material such as polyethylene foam. Most preferably the spline is formed of cross-linked polyethylene foam such as Volara Type AF which has a density of 2 lbs./ft.$^3$ and is manufactured by Zellerbach, Inc. The spline is an elongated piece of material that is threaded into the frame between the rear portions of the frame and the rear outermost layer of the composite tackable member. Most preferably the spline is an elongated square material approximately 0.300 inches to 0.450 inches thick. The spline is inserted between the frame and the substrate to fill any space that may exist and aids in retaining the composite tackable member firmly in the frame.

Preferably a tackable tile made in accordance with the present invention has a flammability rating of at least a Class C in accordance with the National Fire Protection Act [NFPA] 101 Life Safety Code.

The foregoing description of the preferred embodiments of the present invention have been presented for purposes of illustration and description. They are not intended to be exhaustive or to limit the invention to the precise forms disclosed, and obviously many modifications and variations are possible in order to best explain the principles of the invention and various embodiments and with various modifications as are suited to the particular use contemplated. It is intended that the scope of the invention be defined by the following claims, including all equivalents.

We claim:

1. A tackable tile for mounting to a wall frame to provide a tackable surface on the exposed face of a wall comprising one or more tiles on said frame, said tackable tile comprising:

a tile frame defining an open central portion;

a composite tackable member conforming to the perimetric shape of said tile frame and mounted in the open central portion thereof, said composite tackable member comprising:

a pierceable, tack-retaining layer formed of a resilient pierceable polymeric material, said pierceable layer having a front face oriented toward the exposed face of the wall, and a rear face; and an acoustic layer of an acoustic material adjacent to the rear face of the pierceable layer;

wherein the tack-retaining layer is adapted to allow a tack to pierce into the polymeric material and be retained by the polymeric material.

2. A tackable tile according to claim 1, wherein said tile frame further comprises an upper and lower rail, each having a channel, and a first and second end cap each having a channel such that a continuous channel is formed about the periphery of the frame into which the composite tackable member is fitted.

3. A tackable tile according to claim 1, wherein said composite tackable member further comprises at least one layer of fire resistant material, said material being adhered to at least one layer of said composite tackable member.

4. A tackable tile according to claim 3 wherein said layer of fire resistant material is formed of aluminum having a thickness of approximately 0.00009 inches to approximately 0.0035 inches thick.

5. A tackable tile according to claim 1 further comprising a decorative fabric wrap surrounding said frame and a front outermost layer of said composite tackable member.

6. A tackable tile of claim 1, wherein said layer of resilient pierceable material comprises polyvinyl chloride.

7. A tackable tile of claim 1, wherein said layer of acoustic material has a greater density about a central portion of the composite than about an outermost periphery of said composite.

8. A tackable tile of claim 7, wherein said layer of acoustic material is formed of uncured fiberglass having a density of approximately 5 lbs/ft$^3$ to approximately 12 lbs/ft$^3$ about said central portion of said composite.

9. A tackable tile according to claim 7 wherein said layer of acoustic material is formed of uncured fiberglass having a density of approximately 1 lbs/ft$^3$ to approximately 6 lbs/ft$^3$ about said outermost periphery of said composite.

10. A tackable tile according to claim 1, wherein said composite tackable member further comprises at least one layer of aesthetic coveting material, said material being adhered to a front layer and a rear layer of said composite tackable member.

11. A tackable tile according to claim 10, wherein said layer of aesthetic coveting material is formed of polyester rayon having a thickness of between approximately 0.0005 inches to approximately 0.0015 inches.

12. A tackable tile according to claim 1, wherein said composite tackable member further comprises at least one layer of film bonding material, said material being adhered to at least one layer of said composite tackable member.

13. A tackable tile according to claim 12, wherein said layer of film bonding material is formed of film Suflyn TM having a thickness of between approximately 0.0005 inches to approximately 0.0050 inches.

14. A tackable tile according to claim 1 further comprising a spline formed of a resilient flexible material, wherein said spline is inserted between an inner rear portion of the upper and lower rails and the end caps of the frame and a rear outermost layer of said composite tackable material.

15. The tackable tile of claim 1 wherein the pierceable layer is between about 0.02 and about 0.1 inches thick.

16. The tackable tile of claim 1 wherein the acoustic material is fiberglass.

17. The tackable tile of claim 1 further comprising a film bonding material adhering the acoustic layer to the pierceable layer.

18. A composite tackable material comprising:

a pierceable layer of polymeric material which is resilient, flexible and pierceable, which pierceable layer has a front face and a rear face, and which pierceable layer is thinner than the length of a tack; and a layer of acoustic material having a front face adjacent to and substantially completely and continuously covered by the rear face of the pierceable layer;

wherein the composite tackable material is adapted to have a tack inserted from the front face of the pierceable layer, wherein the tack passes into the polymeric material and through the pierceable layer and into the acoustic layer, and wherein the tack is retained by the pierceable layer.

19. The composite tackable material of claim 18 wherein the polymeric material comprises polyvinyl chloride.

20. The composite tackable material of claim 18 wherein the pierceable layer is between about 0.02 and about 0.01 inches thick.

21. The composite tackable material of claim 18 wherein the acoustic material is fiberglass.

22. The composite tackable material of claim 18 further comprising a layer of fire resistant material adhered to at least one of said layers of said material.

23. The composite tackable material of claim 18 wherein the fire resistant material is an aluminum foil.

24. The composite tackable material of claim 18 further comprising a film bonding material adhering the acoustic layer to the pierceable layer.

25. The composite tackable material of claim 18 further comprising a decorative fabric covering the front face of the pierceable layer.

* * * * *

UNITED STATES PATENT AND TRADEMARK OFFICE

CERTIFICATE OF CORRECTION

PATENT NO. : 5,423,151

DATED : June 13, 1995

INVENTOR(S) : Victor V. Caro, et. al.

It is certified that error appears in the above-indentified patent and that said Letters Patent is hereby corrected as shown below:

Title page, item [57], Abstract: col. 2, line 7, delete "memember" and substitute --member--.

Column 7, claim 10, line 3, delete "coveting" and substitute --covering--.
Column 7, claim 11, deelte "coveting" and substitute --covering--.
Column 8, claim 13, line 3, delete "Suflyn" and substitute --Surlyn--.
Column 8, claim 20, line 3, delete "0.01" and substitute --0.1--.
Column 8, claim 23, line 1, delete "18" and subsitutue --22--.

Signed and Sealed this

Second Day of July, 1996

Bruce Lehman

*Attest:*

BRUCE LEHMAN

*Attesting Officer*

*Commissioner of Patents and Trademarks*